US006339845B1

(12) United States Patent
Burns et al.

(10) Patent No.: US 6,339,845 B1
(45) Date of Patent: Jan. 22, 2002

(54) WEARING APPAREL WITH VENTING APPARATUS

(75) Inventors: Jason Burns, Brookfield, MA (US); Susan Poersch, Boulder, CO (US)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/196,223

(22) Filed: Nov. 20, 1998

(51) Int. Cl.[7] ..... A41D 27/28

(52) U.S. Cl. ..... 2/243.1; 2/93; 2/108; 2/227; 2/DIG. 1

(58) Field of Search ..... 2/DIG. 1, 108, 2/115, 94, 255, 262, 264, 232, 336, 93, 247, 252, 87, 79, 82, 227, 243.1

(56) References Cited

U.S. PATENT DOCUMENTS

| | | | | | |
|---|---|---|---|---|---|
| 963,815 | A | * | 7/1910 | Schuller | 2/252 |
| 1,252,187 | A | * | 1/1918 | Shane | 2/DIG. 1 |
| 1,679,102 | A | * | 7/1928 | Thompson | 2/DIG. 1 |
| 1,782,000 | A | * | 11/1930 | Collins | 2/132 |
| 2,644,946 | A | * | 7/1953 | Menz et al. | 2/255 |
| 3,045,243 | A | | 7/1962 | Lash et al. | 2/1 |
| 3,153,793 | A | * | 10/1964 | Lepore | 2/DIG. 1 |
| 4,608,715 | A | * | 9/1986 | Miller et al. | 2/DIG. 1 |
| 4,722,099 | A | * | 2/1988 | Kratz | 2/DIG. 1 |
| 4,731,883 | A | * | 3/1988 | Foster | 2/DIG. 1 |
| 5,105,477 | A | * | 4/1992 | Golde | 2/DIG. 1 |
| 5,544,365 | A | * | 8/1996 | Mondy | 2/115 |
| 5,704,064 | A | * | 1/1998 | Van Der Sleesen | 2/DIG. 1 |
| 5,727,256 | A | * | 3/1998 | Rudman | 2/DIG. 1 |

FOREIGN PATENT DOCUMENTS

| | | |
|---|---|---|
| DE | 40381 | 12/1886 |
| DE | 700490 | 12/1940 |
| EP | 0412450 | 2/1991 |
| FR | 718048 | 1/1932 |

OTHER PUBLICATIONS

Abstract of Japanese Patent Publication No. 08284009 (Komine), published on Oct. 29, 1996.

* cited by examiner

*Primary Examiner*—Amy B. Vanatta
(74) *Attorney, Agent, or Firm*—Greenblum & Bernstein, P.L.C.

(57) ABSTRACT

A venting arrangement for apparel such as sportswear, casual wear, technical wear, and the like. The venting arrangement of the invention is particularly suitable for venting of outdoor apparel and sporting equipment such as wind breakers and winter sport jackets. The invention also relates to apparel or an item of apparel that includes such a venting arrangement.

29 Claims, 4 Drawing Sheets

Fig. 1
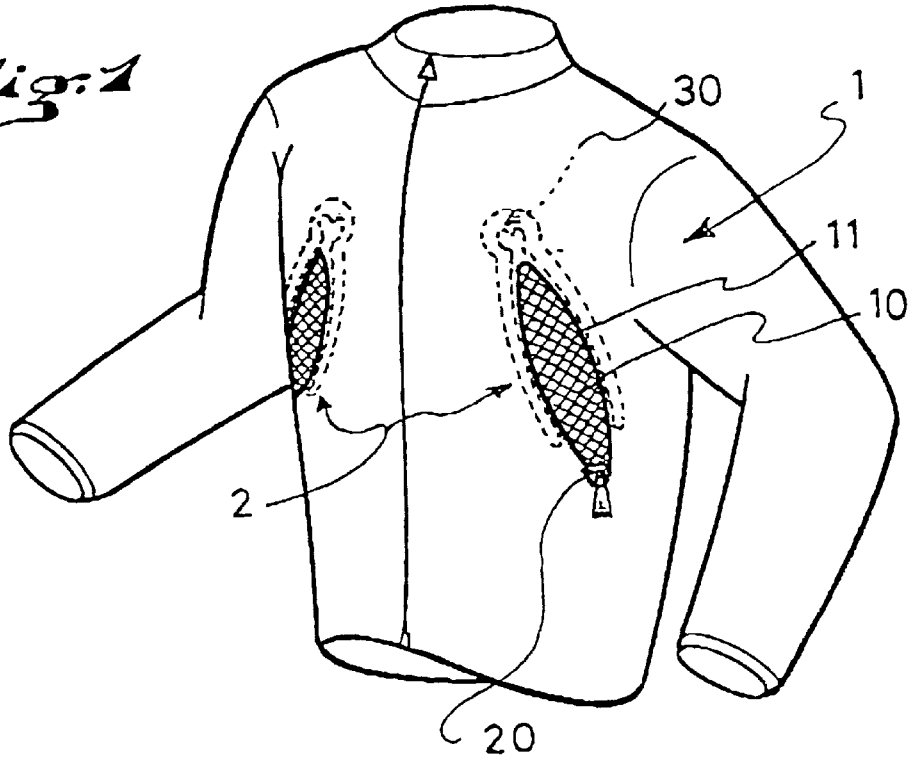
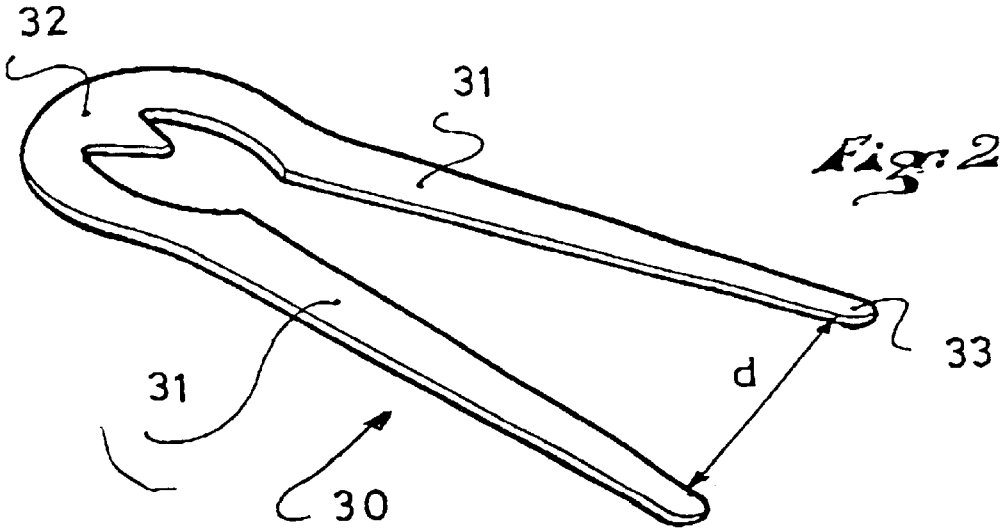
Fig. 2

WEARING APPAREL WITH VENTING APPARATUS

BACKGROUND OF THE INVENTION

1. Field of the Invention

The present invention relates to a venting arrangement for apparel such as sportswear, casual wear, technical wear, and the like. The invention is particularly suitable for venting of outdoor apparel and sporting equipment such as wind breakers and winter sport jackets. The invention also relates to an apparel or an item of apparel that includes such a venting arrangement.

2. Description of Background and Relevant Information

People working in different outdoor occupations or involved in sports and/or open air activities normally wear some kind of waterproof or at least windproof garments.

An important drawback in the use of waterproof or windproof garments is the poor venting of such garments.

Because the material must be waterproof or windproof, it generally also is a barrier to the evaporation of moisture exuded from the body during physical exercise, which further increases the rate of sweating and leads to wetting of clothes worn under the waterproof or windproof garment.

The breathing of waterproof and/or windproof garments can be improved in two ways. The garments can be produced from appropriate materials which are permeable to water vapor but not to condensed water. Garments produced from such materials are characterized by extreme lightweight and a relatively good breathability.

However, such breathable materials are expensive and very fragile. Moreover their breathability is limited to a given ratio of transmission of water vapor which may not always be sufficient for the wearer, and whereby condensation of exudate can still occur especially during strong physical exercise and sweating particularly in sporting activities.

Another way to improve the breathability of garments is to provide them with venting means such as openings, comprising fastening mechanisms to close or open the openings upon need. The problem in such venting means is to keep the opening open enough so as to enable entry of air even when the user is not moving.

Such types of venting means are already known, for example by JP 8284009, wherein a cut, or cut-out, is provided in the outer surface of a cloth, the cut being provided with a zip fastener for its opening/closing and a hook and loop fastener being also provided to maintain the opening open. However, in the venting means, manipulations are required to maintain the cut wide open. Furthermore, such manipulations can be particularly difficult to execute when the user wears gloves such as ski or snowboard gloves. Such a system is therefore not very practical.

SUMMARY OF THE INVENTION

It is an object of the present invention to achieve an efficient and simple venting arrangement for the improvement of ventilation and breathability of apparel, such venting arrangement being adaptable to various types of clothing and also waterproof, windproof clothing, and also any sporting or work clothing.

Therefore, the invention is directed to a venting arrangement for apparel including at least one vent or ventilation opening and means to expand the ventilation opening when increased ventilation is needed, as well as to the item of apparel itself.

In a preferred embodiment, such opening expander is an elastic device which is compressed during closing of the vent, so that the elastic means tend to automatically return to its original shape when the opening is opened, thus widening automatically the opening. Consequently, the opening remains widely open whatever the movements of the wearer, and provides the required ventilation.

BRIEF DESCRIPTION OF THE DRAWINGS

The general nature of the invention has been described above; reference will now be made to the accompanying drawings, showing by way of an illustration, preferred embodiments thereof and in which:

FIG. 1 is a front perspective view of garment incorporating a venting arrangement in accordance with the invention;

FIG. 2 is an enlarged perspective view of an opening expander according to a first embodiment;

DETAILED DESCRIPTION OF THE INVENTION

Figure 3:
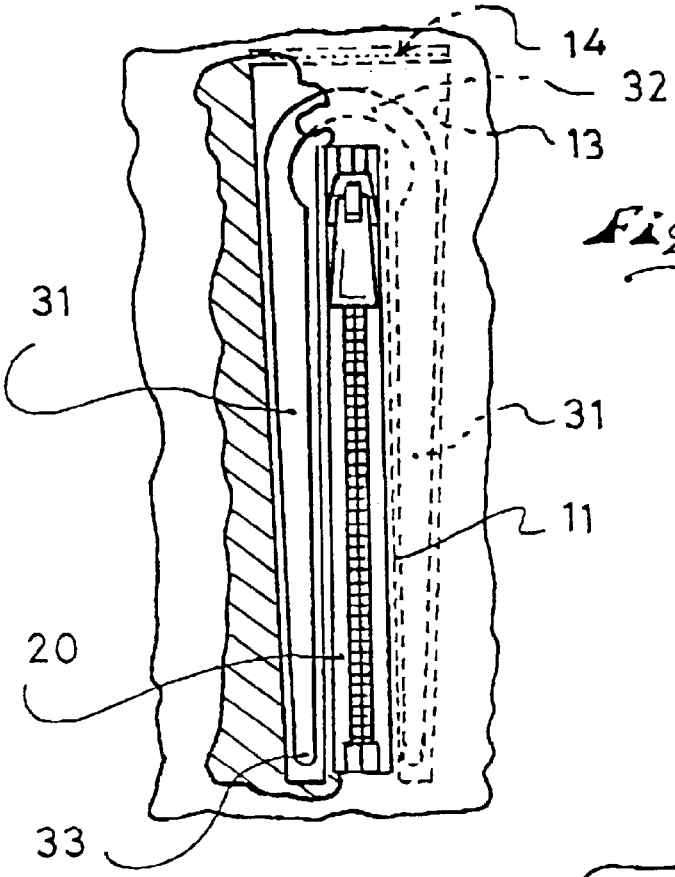
FIG. 3 is a front view, partially cut-away, of a venting arrangement in a closed position.

FIG. 1 shows a garment, such as a sport jacket or wind breaker 1, incorporating on its front side, by way of example, two venting arrangements 2 in accordance with the invention.

Each venting arrangement 2 is basically formed by a vent 10 or ventilation opening, which defines two opposite opening edges 11, which can be closed or opened by a fastening device 20 and to which is associated an opening expander 30 (shown in dotted lines in FIG. 1).

In the present embodiment each vent 10 is formed by a substantially vertical or diagonal slit provided in the material of the garment. Any shape or disposition of such a slit can be conceived without departing from the spirit and scope of the invention.

The fastening device 20 is preferably formed by a quick-closing type fastening means such as a zipper or hook-and-loop fasteners. Any other type of quick closing fasteners can be utilized.

In the exemplary configuration of FIG. 1, the opening of the vent 10 is lined with a mesh fabric 12 fixed to the edges 11 of the opening. Such a mesh fabric 12 enables air to circulate through the opening of the vent 10. The mesh fabric is preferably fixed by sewing or gluing to the edges of the vent, although any other affixation method or means can be utilized.

As can be seen in the figures, the opening of the vent 10 and the fastening device 20 extend in concurrent orientations, i.e., more or less contained within the general plane or surface of the garment to which the vent is to be incorporated. For example, the edges of the vent 10 and the edges of the fastening device 20 are generally the same or could be said to be generally parallel. Further, the opening of the vent is shown to face away from the garment, i.e., the jacket of FIG. 1; for example, at the front of the jacket, the opening of the vent faces forwardly. It is also noted that the fastening device 20, such as the zipper in FIGS. 1, 3, and 4, has permanently closed ends. In FIG. 4, although the vent is shown in an open position, with the zipper pull at the bottom of the vent opening, the upper end of the zipper remains closed.

The opening expander 30 is shown more clearly in FIG. 2. The opening expander 30 includes an elastic elongate pin having substantially a V shape with two legs 31 which are joined at their apex by a semi-circular connection part 32 and which are spaced apart at rest, i.e., when no stress is applied thereto, by a given distance "d" which increases from their connection 32 to their free end 33.

The opening expander 30 is made of a resilient material and preferably a plastic material, although any other material having such properties can apply.

Figure 4:
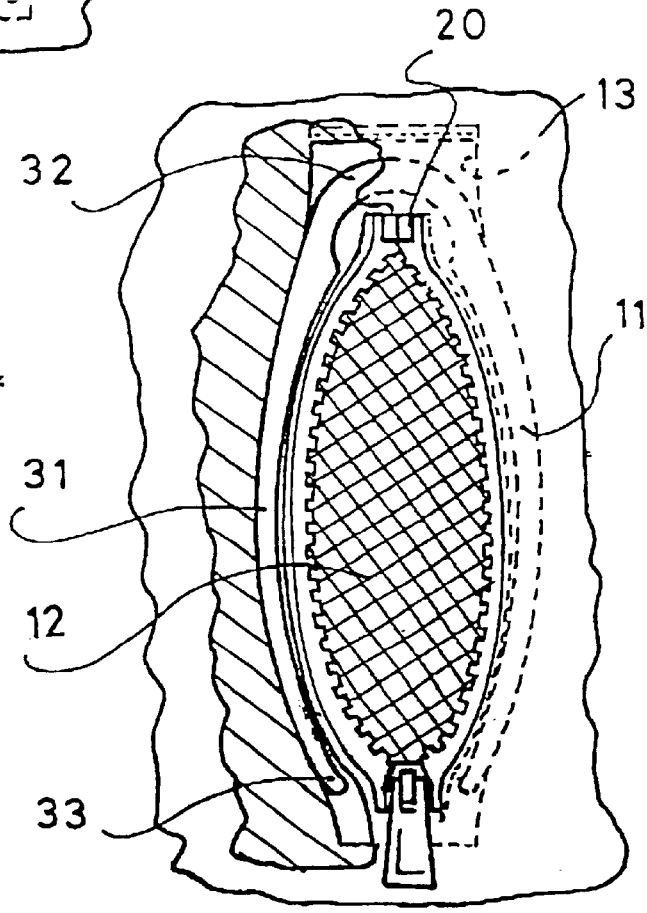
FIG. 4 is a view similar to FIG. 3 in an open position of the venting arrangement.

FIGS. 3 and 4 illustrate the positioning of the opening expander 30 within the vent 10 and its functioning.

A pocket 13 is provided on the inside of the garment I along the edges 11 of the vent 10. The pocket 13 can receive the opening expander 30, each leg 31 of which fits into the pocket along one edge 11 of the vent. The pocket 13 can be completely closed so that the opening expander is fixed in position or can be provided with an opening 14 at its upper end to enable the easy removability of the opening expander 30.

As will be easily understood, when the vent 10 is closed by maneuvering the zipper 20. The free ends 33 of the opening expander 30 are brought substantially together, reducing their mutual distance d, and thus compressing the expander 30.

As soon as the zipper 20 is opened, the opening expander 30 tends to return elastically to its initial rest position with the legs 31 spaced apart thus automatically forcing the vent 10 to remain in a wide open configuration.

Figure 5:
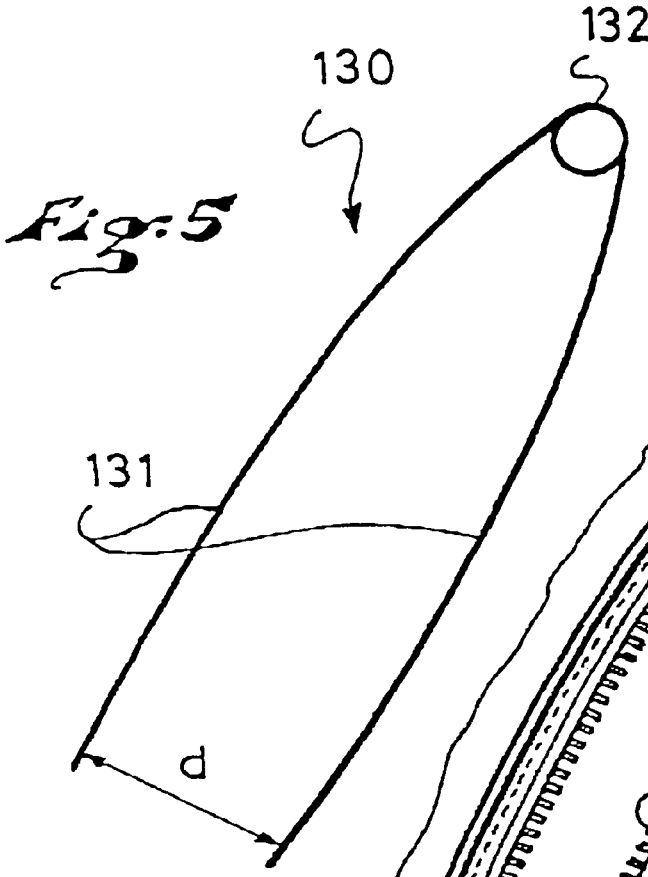
FIG. 5 is a schematic view of an opening expander according to a second embodiment.
Figure 6:
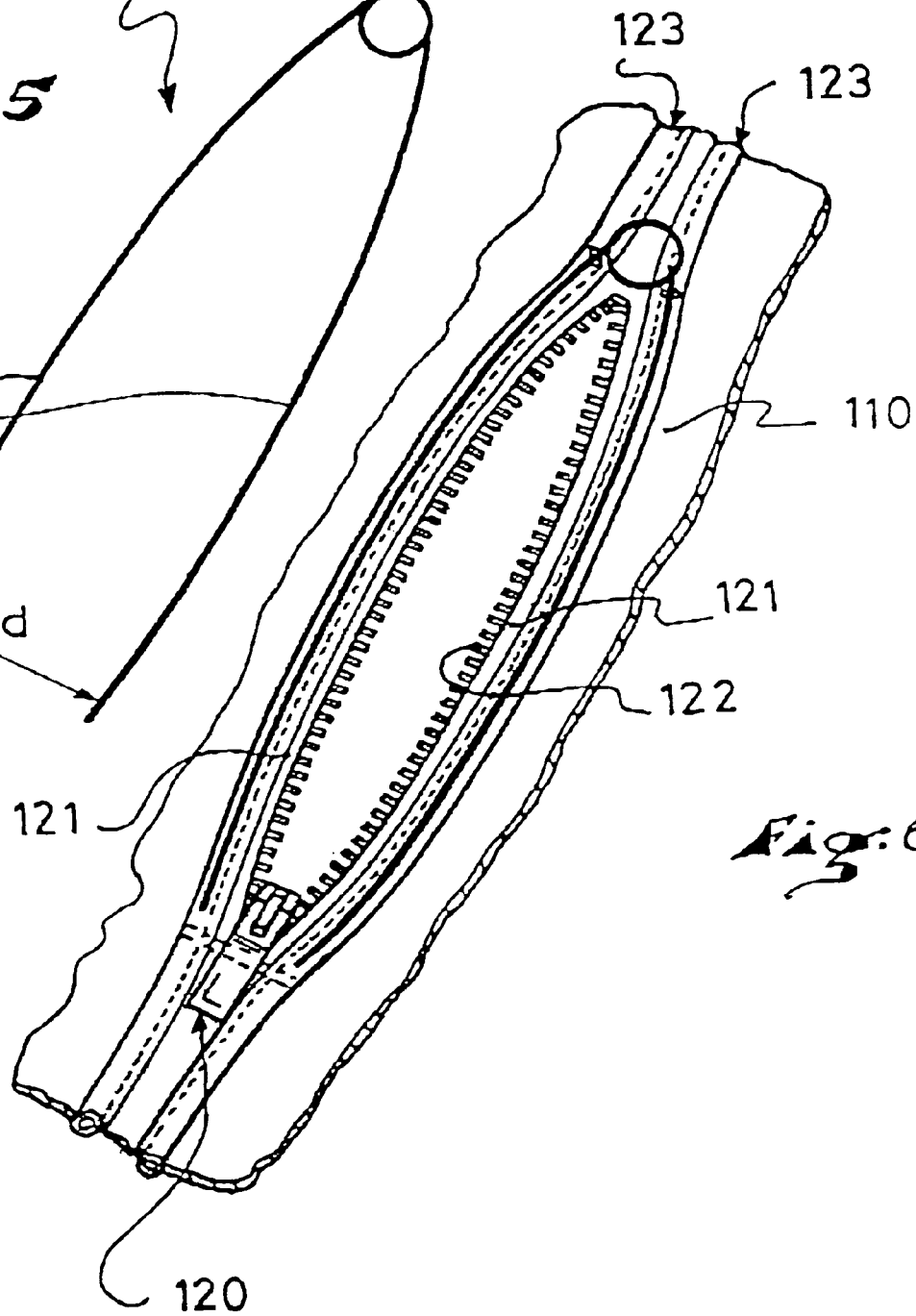
FIG. 6 is a front view of a venting arrangement in an open position.

In the embodiment of FIGS. 5 and 6, the opening expander 130 is formed by a simple wire pin, having two legs 131, which at rest have a slightly bowed construction and which are joined at their apex by a circular loop 132. As for the plastic pin 30, the legs 131 of the wire pin 130 are spaced apart by a given distance "d" at rest.

A primary difference between this embodiment and the one of FIGS. 1–4 is that the wire pin 130 is mounted on the zipper 120 itself.

The zipper 120 is formed conventionally of two tapes 121, which are linked together by the teeth of racks 122 mounted on the adjacent edges of both tapes.

In the present case, a tunnel 123 is formed on the external edge of each tape 121, in order to accommodate each leg of the wire pin 130. As the legs have a small section, the tunnels also have a small transverse section.

The functioning is the same as explained above, i.e., the wire pin 130 is compressed during closing of the zipper 120 and pops the opening of the vent 110 wide open as soon as the zipper is opened.

Figure 7:
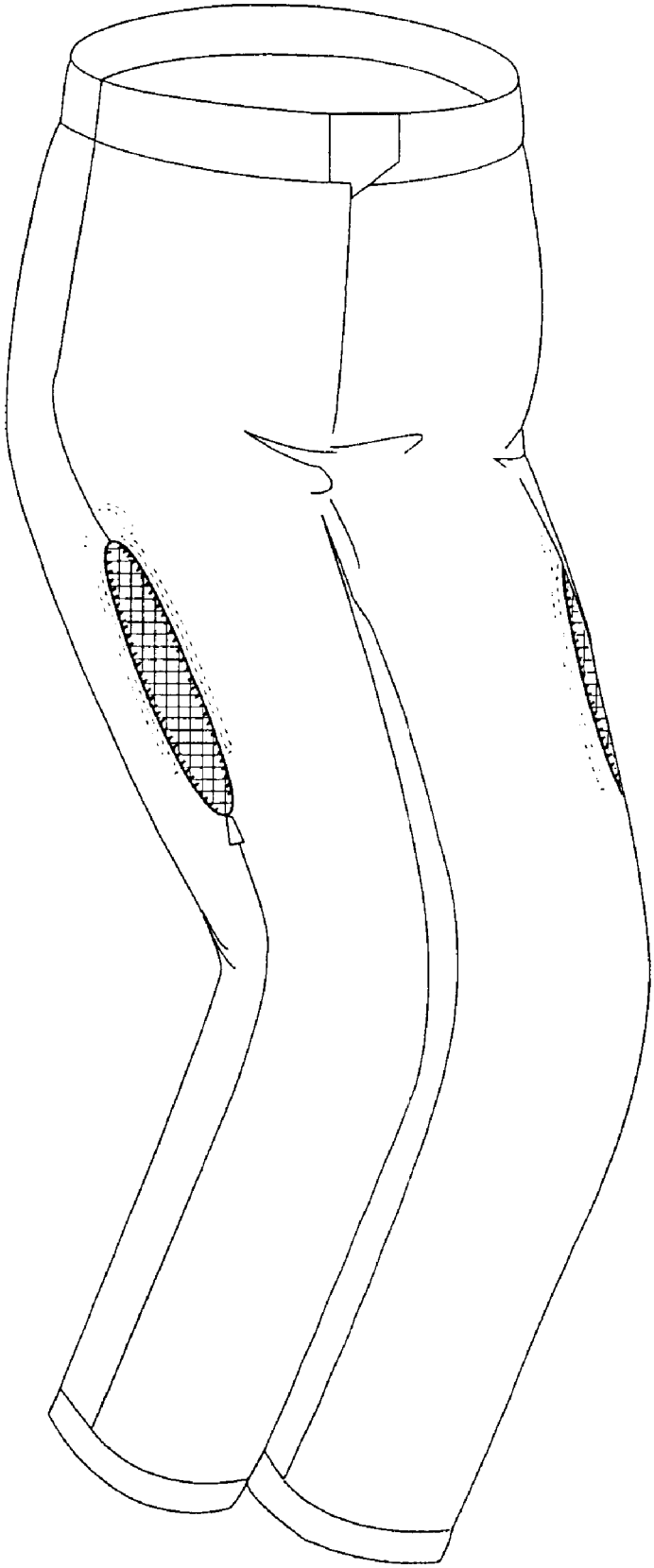
FIG. 7 is a front perspective view of the venting arrangement according to the invention as applied to a pair of pants.

Although described in relation with a sport jacket, the present invention is not limited to such an embodiment but can be applied to any apparel or item of apparel, wherein the problem of venting has to be solved. It can particularly be applied to any sporting jacket or pants, or any outdoor jacket or pants, including specific working apparel or summer/winter apparel, as shown in FIG. 7.

The venting arrangement will also preferably be located on the item of apparel in a location proximate to an exudate region of the body such as the chest, armpits, etc., for a jacket and such as the front, rear and/or along the legs for pants. Although FIG. 1 illustrates a pair of vents positioned slightly inclined from a vertical orientation on the front of the torso-covering part of a jacket, the orientation and shape of the vent(s) can be varied from that illustrated.

The invention is not limited to the particular embodiments shown and described, but can include other equivalent variations encompassed by the claims that follow.

What is claimed is:

1. A venting arrangement for apparel comprising a vent, a fastening device associated to said vent for closing/opening said vent, wherein an opening expander is associated to said vent or to said fastening device to open said vent automatically in response to opening of said fastening device, said vent comprising an opening generally contained within a general plane of said apparel and having an orientation generally concurrent with an orientation of said fastening device.

2. A venting arrangement according to claim 1, wherein said fastening device is a zipper.

3. A venting arrangement according to claim 1, wherein said fastening device is a hook and loop fastener.

4. An item of apparel comprising a venting arrangement according to claim 1, located proximate an exudate region of the body of the wearer.

5. A venting arrangement according to claim 1, wherein:

said vent comprises two opposite edges defining an opening through which air is permitted to flow, said fastening device comprising means for bringing said edges toward each other for closing said vent.

6. A venting arrangement for apparel comprising a vent, a fastening device associated to said vent for closing/opening said vent, wherein an opening expander is associated to said vent or to said fastening device to open said vent automatically in response to opening of said fastening device, wherein said opening expander is elastic, said elastic opening expander being compressed upon closing of said vent against a force exerted by said opening expander generally parallel to a general plane of said apparel.

7. A venting arrangement according to claim 6, wherein said opening expander comprises an elongated elastic member having two legs, both legs having a mutual given spacing in a rest position, each said leg extending along a respective edge of said vent, a mutual spacing of said legs in a closed position of said fastening means being smaller than said given spacing.

8. A venting arrangement according to claim 7, wherein said opening expander is a plastic pin.

9. A venting arrangement according to claim 7, wherein said opening expander is a metal wire.

10. A venting arrangement for apparel comprising a vent, a fastening device associated to said vent for closing/opening said vent, wherein an opening expander is associated to said vent or to said fastening device to open said vent automatically in response to opening of said fastening device, said vent comprising an opening having an orientation generally concurrent with an orientation of said fastening device, wherein said opening expander is removably fitted in pockets provided on each side of said vent.

11. A venting arrangement according to claim 10, wherein said pockets are provided on each said side of said vent.

12. A venting arrangement for apparel comprising a vent, a fastening device associated to said vent for closing/opening said vent, wherein an opening expander is associated to said vent or to said fastening device to open said vent automatically in response to opening of said fastening device, said vent comprising an opening having an orientation generally concurrent with an orientation of said fastening device, wherein said opening expander is fixed in pockets on each side of said vent.

13. A venting arrangement for apparel comprising a vent, a fastening device associated to said vent for closing/opening said vent, wherein an opening expander is associated to said vent or to said fastening device to open said vent automatically in response to opening of said fastening device, said opening expander being removably fitted in pockets provided on each side of said vent, said pockets being provided along the edges of the fastening device.

14. A venting arrangement for an item of apparel comprising:

a vent having two opposite edges defining an opening;

said opposite edges being detachably affixed in a closed configuration and said opposite edges being spaced apart in an open configuration to define an opening facing away from said item of apparel;

an opening expander comprising an elastic member acting on at least one of said edges to force said vent in said open configuration.

15. A venting arrangement for apparel comprising a vent, said vent having a length defined by opposite edges, a fastening device associated to said vent for closing/opening said vent, wherein an opening expander is associated to said vent or to said fastening device to open said vent automatically in response to opening of said fastening device, wherein said opening expander comprises a unitary elastic device, said elastic device having a length extending along said length of said vent.

16. A venting arrangement according to claim 15, wherein:

said opening expander for said vent consists of said unitary elastic device.

17. An item of apparel comprising:

a garment for covering a part of a body of a wearer;

at least one venting arrangement for said garment comprising a vent, a fastening device associated to said vent for closing/opening said vent, and an opening expander associated to said vent or to said fastening device to open said vent automatically in response to opening of said fastening device, said vent comprising an opening having an orientation generally concurrent with an orientation of said fastening device, said opening of said vent extending generally within a plane facing away from said garment.

18. An item of apparel according to claim 17, wherein:

said garment comprises a sporting jacket.

19. An item of apparel according to claim 17, wherein:

said garment comprises pants.

20. An item of apparel according to claim 17, wherein:

said vent comprises two opposite edges defining an opening through which air is permitted to flow, said fastening device comprising means for bringing said edges toward each other for closing said vent.

21. An item of apparel according to claim 17, wherein:

said opening of said vent is on a front portion of said garment and is forwardly facing.

22. An item of apparel according to claim 17, wherein:

said fastening device comprises a zipper having a zipper pull and a pair of permanently closed opposite ends, whereby said zipper has portions defining a closed periphery of said opening of said vent in said open position.

23. An item of apparel comprising:

a garment for covering a part of a body of a wearer;

at least one venting arrangement for said garment comprising a vent, said vent having a length defined by opposite edges, a fastening device associated to said vent for closing/opening said vent, and an opening expander associated to said vent or to said fastening device to open said vent automatically in response to opening of said fastening device, said opening expander comprising a unitary elastic device, said elastic device having a length extending along said length of said vent.

24. A venting arrangement according to claim 23, wherein:

said opening expander for said vent consists of said unitary elastic device.

25. A venting arrangement for apparel comprising:

a vent having a closed position and an expanded open position;

a fastening device having portions defining an opening of said vent in said expanded open position, said opening of said vent generally contained within a surface of said apparel, said fastening device being movable between an unfastened position and a fastened position for respectively (1) allowing opening of said vent to said expanded open position and (2) closing said vent;

means for expanding said vent to said expanded open position in response to said fastening device being placed in said unfastened position.

26. A venting arrangement for apparel comprising:

a vent having a closed position and an expanded open position;

a fastening device associated to said vent, said fastening device being movable between an unfastened position and a fastened position for respectively (1) allowing opening of said vent to said expanded open position and (2) closing said vent;

means for expanding said vent to said expanded open position in response to said fastening device being placed in said unfastened position;

said vent comprising a pair of edges selectively movable toward each other, in said closed position, and away from each other, in said expanded open position, said pair of edges being generally contained within a surface of said apparel in said open position; and said means for expanding said vent comprising an elastic device arranged with respect to said pair of edges to force said edges away from each other upon placing said fastening device in said unfastened position.

27. An item of apparel comprising:

a garment for covering a part of a body of a wearer;

at least one venting arrangement for said garment comprising a vent, said vent having a closed position and an expanded open position;

a fastening device having portions defining an opening of said vent in said expanded open position, said opening of said vent generally contained within a surface of said apparel, said fastening device being movable between an unfastened position and a fastened position for respectively (1) allowing opening of said vent to said expanded open position and (2) closing said vent;

means for expanding said vent to said expanded open position in response to said fastening device being placed in said unfastened position.

28. An item of apparel comprising:

a garment for covering a part of a body of a wearer;

at least one venting arrangement for said garment comprising a vent, said vent having a closed position and an expanded open position;

a fastening device associated to said vent, said fastening device being movable between an unfastened position and a fastened position for respectively (1) allowing opening of said vent to said expanded open position and (2) closing said vent;

means for expanding said vent to said expanded open position in response to said fastening device being placed in said unfastened position;

said vent comprising a pair of edges selectively movable toward each other, in said closed position, and away from each other, in said expanded open position, said pair of edges being generally contained within a surface of said apparel in said open position; and said means for expanding said vent comprising an elastic device arranged with respect to said pair of edges to force said edges away from each other upon placing said fastening device in said unfastened position.

29. An item of apparel comprising:

a garment for covering a part of a body of a wearer;

at least one venting arrangement for said garment comprising a vent, a fastening device associated to said vent for enabling manual positioning said vent in a closed position and in an open position, and an opening expander associated to said vent to open said vent in response to opening of said fastening device, said fastening device having edges defining an opening of said vent in said open position, said fastening device further having a pair of opposite permanently closed ends, said opening expander having a length extending along edges of said opening of said vent.

* * * * *